US005120052A

United States Patent [19]

Evans

[11] Patent Number: 5,120,052

[45] Date of Patent: Jun. 9, 1992

[54] ABDOMINAL EXERCISE APPARATUS THAT PROVIDES FOR INCREASED ELONGATION OF THE ABDOMINAL MUSCLES

[76] Inventor: Layne Evans, 685 N. Eden Dr., Idaho Falls, Id. 83401

[21] Appl. No.: 566,181

[22] Filed: Aug. 10, 1990

[51] Int. Cl.[5] ..... A63B 101/00; A63B 21/00

[52] U.S. Cl. ..... 482/145; 128/25 R; 482/140

[58] Field of Search ..... 272/93, 116, 125, 126, 272/127, 130, 134, 143, 144, 145, 902, 903, DIG. 4; 128/25 R, 25 B

[56] References Cited

U.S. PATENT DOCUMENTS

| | | | |
|---|---|---|---|
| 1,836,981 | 12/1931 | Matheson | 272/134 X |
| 1,904,039 | 4/1933 | Bruder | 272/144 X |
| 4,230,099 | 10/1980 | Richardson | 128/69 |
| 4,546,967 | 10/1985 | Kecala . | |
| 4,650,187 | 3/1987 | Chenera | 272/145 |
| 4,725,056 | 2/1988 | Rehrl et al. | 272/134 |
| 4,746,115 | 5/1988 | Lahman | 272/134 X |
| 4,752,067 | 6/1988 | Colonello | 272/93 |

FOREIGN PATENT DOCUMENTS

| | | | |
|---|---|---|---|
| 3632124 | 4/1988 | Fed. Rep. of Germany | 272/144 |
| 8803825 | 6/1988 | World Int. Prop. O. | 272/145 |

*Primary Examiner*—Richard J. Apley
*Assistant Examiner*—Joe Cheng

[57] ABSTRACT

This apparatus is for the development of the abdominal muscles through their ranges of motion including that known as elongation. The objective of the apparatus is to build muscle power and endurance, not only when the abdominal muscles are mostly contracted, but also when the abdominal muscles are mostly elongated.

The apparatus includes an outward arch which fits under the upper lumbar and lower thoracic spine. One slope of the arch provides the user's pelvis and lumbar spine with consistent support. The rest of the arch provides the user's remaining spine to be supported when resting, but to be free to arch beyond the amount of arch that occurs in normal standing posture. This exercise is made functional by a knee retainer that holds down on the knees which, in turn, holds down on the pelvis, thereby creating maintainable contact between the pelvis/low-lumbar area and the slope of the arch.

5 Claims, 2 Drawing Sheets

ABDOMINAL EXERCISE APPARATUS THAT PROVIDES FOR INCREASED ELONGATION OF THE ABDOMINAL MUSCLES

FIELD OF THE INVENTION

This invention relates to an apparatus for use in exercise of the abdominal muscles; specifically it relates to a design that provides for muscle development through the range of motion that occurs with substantial elongation of the abdominal muscles.

BACKGROUND OF THE INVENTION

The science of physical exercise has long agreed that range of motion is a determining factor of the quality of an exercise apparatus. If an apparatus provides a format of complete range of motion wherein the muscle is challenged when it is elongated as well as when it is contracted, that apparatus is a better as well as when it is contracted, that apparatus is a better provider of muscle development than a lesser range of motion apparatus.

Heretofore, abdominal exercise apparatus have provided only partial range of motion for the abdominal muscles. They do not provided for elongation beyond a middle range of the muscles potential motion. At worst they stop elongating the abdominal muscles when the back is flat: as in the sit-up or curl. And at best they provide the small increase in elongation that occurs when the low lumbar spine is arched to a degree of normalcy in ordinary posture. This is also called "normal lumbo-sacral arch" as in U.S. Pat. No. 4,752,067 to Colonello, Jun. 21, 1988. Neither is acceptable because the abdominal muscles can elongate inches farther than these middle ranges. More complete elongation of the abdominal muscles occurs when the lumbar and thoracic spine are super arched, or in other words, are arched beyond the degree of arch that is common to ordinary posture.

The act of super arching the spine is very common in sports. For example, super arching of the spine is a natural part of overhand throwing. Baseball and softball players perform this motion over and over. As they cock the ball above and behind their shoulder, they super arch their spine. Then, as the ball is thrown, they contract their abdominal muscles and pull or "sling the upper torso forward, thereby adding force to the throwing motion.

OBJECTS AND ADVANTAGES OF THE INVENTION

This apparatus is for the development of the abdominal muscles through their ranges of motion including that known as elongation. The objective of the apparatus is to build muscle power and endurance, not only when the abdominal muscles are mostly contracted, but also when the abdominal muscles are mostly enlongated or in other words fully extended.

This elongation included exercise of the abdominal muscles may be only for the advanced exerciser, or it may be usable by anyone; that is yet to be determined. However, it appears that overhand throwers, especially baseball players, are would-be user's of this apparatus because of the importance of elongation included abdominal muscle strength to the function of overhand throwing. When the abdominal muscles are elongated and then contracted with power, they drive or "sling" the upper torso forward. This is a key function of overhand throwing and it is a function that is mirrored in the exercise motion provided by this apparatus.

The apparatus includes an outward arch which fits under the thoracic spine. One slope of the arch provides the user's pelvis with consistent support. The rest of the arch provides the user's remaining torso to be supported when resting, but to be free to move through a range of motion of the spine that includes the ranges that occur when the abdominal muscles are substantially elongated.

Use of the outward arch is functional because the user places his or her knees under a retaining assembly that retains the knees. The knee retainer includes a retainer carriage concaved parallel to the legs in order to retain the nees anteriorly. The knee retainer opposes movement of the thighs longitudinally towards the knees. Because it is located relative to the pelvis supporting slope of the arch the knee retainer opposes anterior tilting of the pelvis while abdominal muscle exercises are performed.

The device includes a foot supporting area that provides means for the feet to support the function of the knee retainer.

It includes the connection between the support post and the exercise base, and it also includes the foot station.

DETAILED DESCRIPTION OF THE PREFERRED EMBODIMENT

Figure 2:
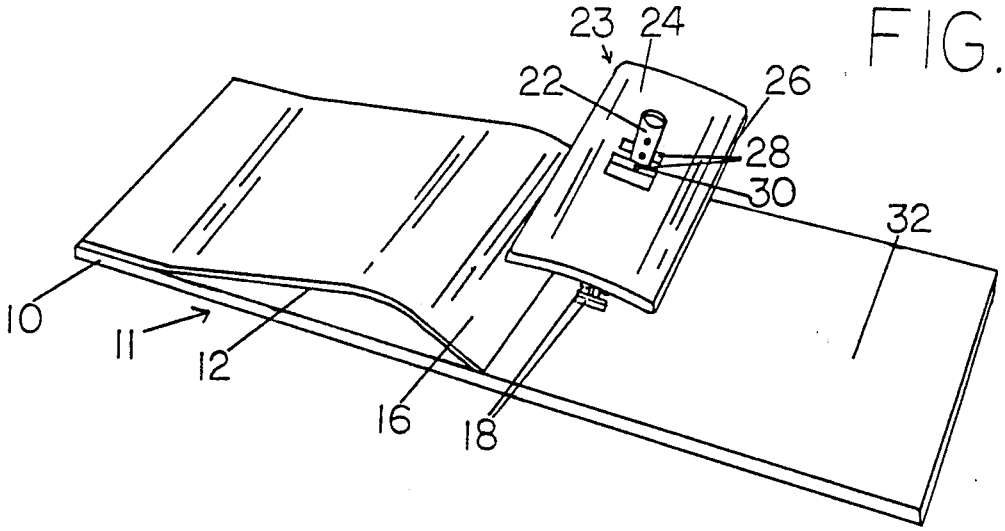
FIG. 2 is a perspective view of the apparatus.

FIG. 2 shows a perspective view of the apparatus. Apparatus features include a rectangular, flat exercise base 10 which sets on the floor. It is approximately as long as an average man, and it is approximately one and a quarter times as wide as an average man's shoulders. All other features are secured to this solid, smooth surface. It is make of sufficiently strong metal to resist flexing or bending under the weight of a user.

The receiving base 11 (best seen in exploded view in FIG. 3) includes a receiving base carriage 12 that is welded along two ends to the exercise base 10. It is made of sufficiently strong metal so that human weight will not bend it. One important variation from the flatness of this receiving base carriage 12 is a smooth, outward arch. The arch is free of sharp angles, and the apex of the arch is rounded so as to be comfortable under a user's spine. The areas of the receiving base carriage 12 which are not part of the bend, are divided, giving about one third to the pelvis supporting slope and two thirds to the other side or slope.

Figure 3:
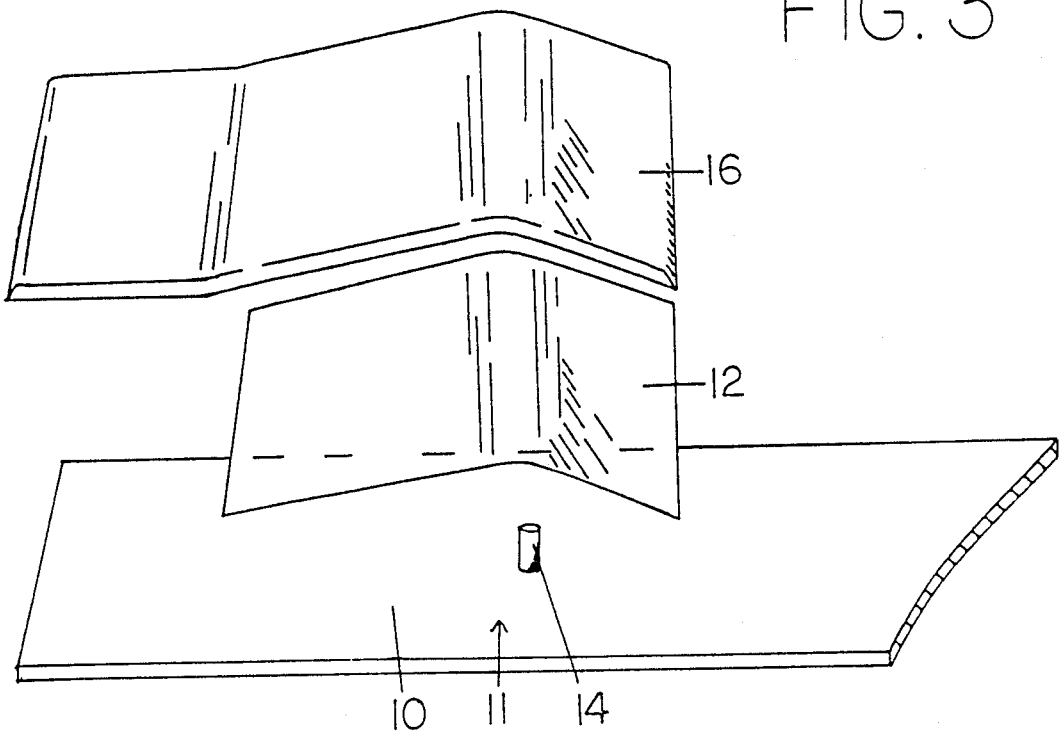
FIG. 3 is an exploded, side view of the receiving base assembly.

The receiving base carriage 12 is supported by a solid support block 14, as shown in FIG. 3. This support block is welded in place on the exercise base 10, under the center of the arch. Also shown in FIG. 3 is the receiving padding 16, made of foam rubber that is covered in vinyl. This receiving padding 16 covers the receiving base carriage 12 as well as the portion of the exercise base 10 that receives the back of the user's head. The padding is glued to the apparatus.

Figure 5:
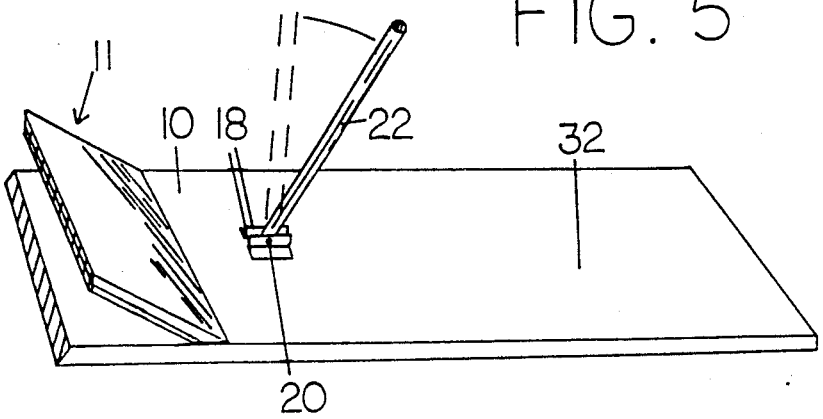
FIG. 5 is a perspective, partial view of the exercise apron.

FIG. 5 shows the connection between the exercise base 10 and the support post 22. The post mounts 18 are identical angle iron pieces of about one-quarter inch thickness. They are welded onto the middle of the exercise base 10 at approximately four inches from the receiving base 11 and contiguous to the terminal end of the pelvis supporting slope. The post mounts 18 mirror each other and are wide enough apart to receive the support post between them. They are drilled along with the support post 22, so the joint rivet 20 can be inserted, thereby giving the support post 22 a solid connection to the exercise base 10. A connection that resists lateral movement of the support post 22, but provides for support post 22 movement toward and away from the user's torso so as to make the knee retainer 23 more adjustable.

Figure 4:
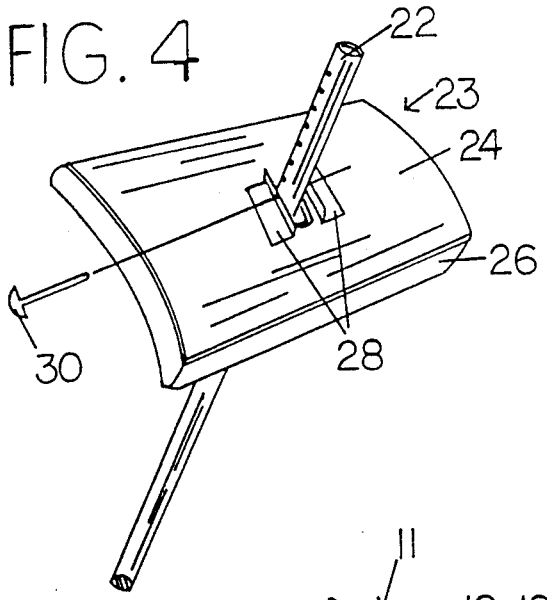
FIG. 4 is a perspective view of the knee retainer assembly.

In FIG. 4 we see the knee retainer 23 and its connection to the support post 22. The knee retainer 23 includes a retainer carriage 24 made of metal that is concaved parallel to the exerciser's legs to retain a user's bent knees anteriorly. Retainer padding 26, of vinyl covered foam rubber fills the concave side of the retainer carriage 24. There is a hole through the middle of the retainer carriage 24 and the retainer padding 26 that is large enough to permit the support post 22 to pass through freely.

On the back side of the retainer carriage 24, the selector mounts 28 are welded on the retainer carriage opposite to either side of the post hole. These selector mounts 28 are similar to the post mounts 18. The selector mounts 28, as well as the support post 22, are drilled so that they can receive the selector pin 30 freely. The support post 22 has multiple holes through it at approximately one inch intervals; these provide for height adjustment of the knee retainer 23. The selector pin 30 is a hand held pin that can be easily inserted into, as well as removed from, the holes in both the selector mounts 28 and the support post 22.

Figure 1:
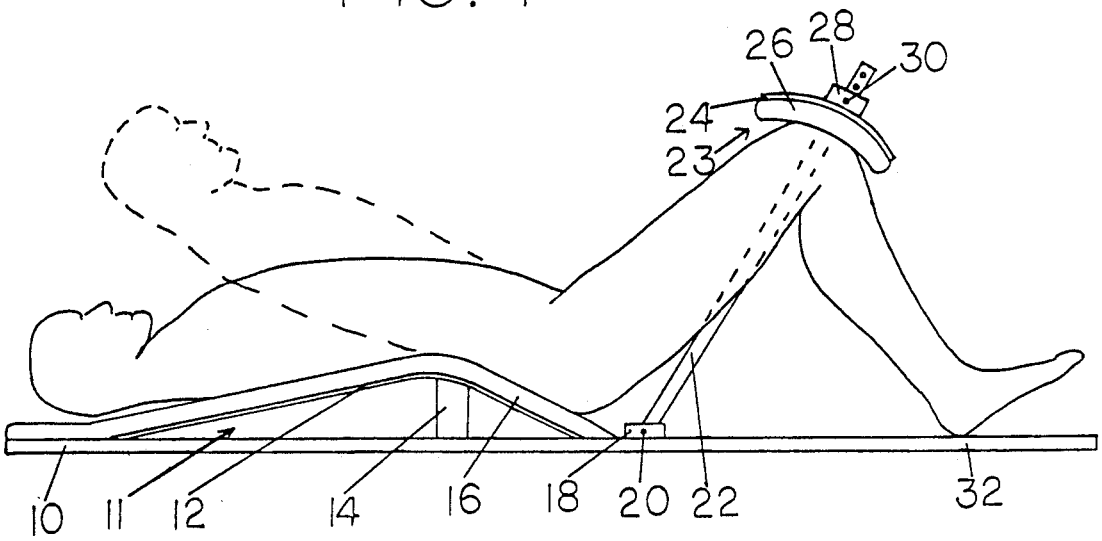
FIG. 1 is a side view of the apparatus wherein an exerciser is shown using the apparatus. This view provides two silhouettes of the user to show range of motion.

The foot station 32 can be seen in FIGS. 1, 2, and 5. It is the extended end of the exercise base.

OPERATION OF THE INVENTION

FIG. 1 shows an exerciser using the apparatus. The double silhouette exemplifies a range of motion involved in peforming the exercise.

To use the apparatus, a user first sits on the receiving base 11, on the slope of the arch that is closest to the knee retainer 23. The user than positions his or her knees under the knee retainer 23, and his or her feet on the foot station 32. The user's knees should be bent at approximately a ninety degree angle. The user is now ready to adjust the knee retainer 23. This function is best seen in FIG. 4.

The knee retainer 23 is adjusted by following a few steps. First, remove the selector pin 30 from the selector mounts 28. Second, slide the knee retainer 23 down the support post 22 until the knee retainer 23 is resting on the knees. And finally, reinsert the selector pin 30 through the selector mounts 28 and the adjacent hole of the support post 22; the support post 22 having multiple holes whereby it accomplishes this adjustment.

The user then reclines posteriorly onto the receiving base 11 and positions his or her back so the thoracic spine are received by the rounded apex of the arch of the receiving base 11. Another way to establish the correct spine position on the arch is to position the highest area of the arch under the area of the spine that is approximately two inches above the exerciser's belt line. The user's shoulders and the back of the users head should, at this point, be resting on the recline base 11.

If the knee retainer 23 is not tight against the knees, the user can slide the feet, on the foot station 32, toward the buttocks; this will take out any slack between the knees and the knee retainer 23, and in turn, cause the pelvis to fit more tightly to the slope of the recline base 11. The user also has the option of pressing the heels or toes on the foot station 32 which is another way of creating a tighter fit at both the knees and the pelvis.

The user is now positioned correctly for using this apparatus. At this point the user performs sets of repetitions of elongation included abdominal curls.

CONCLUSIONS, RAMIFICATIONS, AND SCOPE OF THE INVENTION

Thus the reader will see that this invention provides means for developing more symmetrically strong abdominal muscles by challenging the muscles through a range of motion that includes substantial elongation.

While the above description contains many specificities, these should not be construed as limitations on the scope of the invention, but rather as an exemplification of one preferred embodiment thereof. Many other variations are possible. For example, the knee retainer could be adjusted by a multiplicity of means that could provide force down on the knees. Either an electric motor or a winch would work, and I'm sure there are other means.

The knee retainer could be rearranged to have a pad just above the knees and a pad just below the knees but with no bowl shaped retainer on the knee itself.

The foot station could have a shelf or step for pressing off of.

If the device where reworked to function in an upright position with weights and a swing arm (like Nautilus equipment), the receiving base could be reduced in size and area of spine support without becoming ineffective.

Also, the exercise base could be done away with and replaced by other support means such as a pipe frame. Accordingly, the scope of the invention should be determined not by the embodiment illustrated, but by the appended claims and their legal equivalents.

I claim:

1. Abdominal muscle exercise apparatus including:

a receiving base to provide support for the exerciser's posterior pelvis and spine, said receiving base including an arch parallel to the spine, wherein the arch including a round apex positioned posterior to the thoracic spine and a slope positioned posteriorly to the pelvis for supporting the pelvis;

an exercise base positioned on a horizontally supported plane for providing a foundation of support for said receiving base; and knee retainer means, said knee retainer means being located on said exercise base and contiguous to the terminal end of said slope, said knee retainer means being positioned anteriorly on the bent knees of the exerciser to oppose movement of the thighs longitudinally toward the knees and being located relative to said receiving base to oppose anterior tilting of the exerciser's pelvis while exercising the abdominal muscles.

2. Abdominal muscles exercise apparatus as in claim 1 wherein said exercise base extends on said horizontal plane and parallel to the exerciser's spine for providing a foundation of support for the exerciser's body during abdominal muscles exercises.

3. Abdominal muscles exercise apparatus as in claim 2, wherein said knee retainer means comprises a retainer carriage and a support post positioned on said exercise base, wherein one end of said support post is secured to said exercise base between the thighs of the exerciser and the other end of said support post connected to said retainer carriage.

4. Abdominal muscles exercise apparatus as in claim 1, wherein said knee retainer means is adjustable for positioning said knee retainer means in a variety of exerciser's body lengths.

5. Abdominal muscles exercise apparatus as in claim 1, wherein said knee retainer means includes a retainer carriage concaved parallel to the exerciser's leg to retain the bent knees of said exerciser during the abdominal muscles exercises.

* * * * *